US006753075B1

(12) United States Patent
Leupolz et al.

(10) Patent No.: US 6,753,075 B1
(45) Date of Patent: Jun. 22, 2004

(54) INFRARED CAMOUFLAGING SYSTEM

(75) Inventors: Andreas Leupolz, Horgenzell (DE); Werner Scherber, Bermatingen (DE); Walter Rothmund, Maxhuette-Haidhof (DE)

(73) Assignee: OGUS Netze & Wirkwaren GmbH & Co. KG, Moenchengladbach (DE)

( * ) Notice: Subject to any disclaimer, the term of this patent is extended or adjusted under 35 U.S.C. 154(b) by 107 days.

(21) Appl. No.: 09/715,260

(22) Filed: Nov. 20, 2000

(30) Foreign Application Priority Data

Nov. 19, 1999 (DE) ..... 199 55 609

(51) Int. Cl.[7] ..... B32B 7/04; B32B 15/00

(52) U.S. Cl. ..... 428/323; 428/457; 428/472; 428/913; 428/919

(58) Field of Search ..... 428/919, 913, 428/323, 458, 662, 469, 472; 89/36.01–36.15; 252/582, 587, 600

(56) References Cited

U.S. PATENT DOCUMENTS 4,496,923 A * 1/1985 Lenzing ..... 336/59
4,529,633 A * 7/1985 Karlsson ..... 428/17
4,560,595 A 12/1985 Johansson ..... 428/17
4,991,797 A 2/1991 Miller et al. ..... 244/117 A
5,036,211 A 7/1991 Scott ..... 250/495.1
5,274,241 A * 12/1993 Radford et al. ..... 250/515.1
2001/0027856 A1 * 10/2001 Okamoto et al. ..... 165/96

FOREIGN PATENT DOCUMENTS

| | | |
|---|---|---|
| FR | 2733311 | 10/1996 |
| FR | 2744515 | 8/1997 |
| JP | 08-144068 | * 11/1994 |
| WO | WO 98/36234 | 8/1998 |

OTHER PUBLICATIONS

European Search Report mailed Aug. 21, 2003.

* cited by examiner

*Primary Examiner*—Paul Thibodeau
*Assistant Examiner*—Nikolas J. Uhlir
(74) *Attorney, Agent, or Firm*—Crowell & Moring LLP

(57) ABSTRACT

An infrared camouflaging system comprises a thermorefractive layer system or a thermorefractive material, whose thermal emissivity has a negative temperature coefficient.

13 Claims, 3 Drawing Sheets

INFRARED CAMOUFLAGING SYSTEM

CROSS-REFERENCE TO RELATED APPLICATIONS

This application is related to pending U.S. patent application Ser. No. 09/715,259, filed Nov. 20, 2000.

BACKGROUND AND SUMMARY OF THE INVENTION

This application claims the priority of German patent document 199 55 609.1, filed 19 Nov. 1999, the disclosure of which is expressly incorporated by reference herein.

The invention relates to a system for infrared (IR) camouflaging of land targets, especially military objects, such as land craft, against thermal-image apparatuses and infrared seeker heads.

The objective of thermal camouflaging is to adapt the thermal radiation emitted by an object which is to be camouflaged, to the level of the respective thermal background, for example by influencing the temperature of the observable surfaces using constructional measures, such as thermal insulation, insulation and rear ventilation. These measures can achieve improvements in the area of an active signature (that is, for internal heat sources, such as engines, transmissions or energy units); however, they do not attain a satisfactory solution with respect to solar heating (passive signature), because the heating behavior of military objects as a rule deviates considerably from that of a natural background. Suggested solutions for compensating these deviations by active afterheating and cooling, such as described, for example, in German Patent Document DE 32 17 977 A1, are not very practical, mainly because of the high energy consumption.

Other known solutions have the goal of achieving a signature reduction by changing the emission behavior of the surface rather than by influencing the actual surface temperature. It is known that the heat emission of a body is determined not only by its temperature but also by the thermal emissivity of its surface. The use of low-emitting surface layers for infrared camouflage is known and described, for example, in German Patent Document DE 30 43 381 A1 and European Patent Document EP 0 123 660 A1.

One problem encountered with this type of low-emitting camouflaging devices is that in principle the IR reflectivity p increases with a reduction of the thermal emissivity $\epsilon$ according to the formula $\rho=1-\epsilon$, so that reflection of the environmental radiation increases. This environmental (reflected) radiation is superimposed on intrinsic emissions, so that the heat radiation (and thus the observable radiation temperature during the reduction of the thermal emissivity) is increasingly also dependent on the temperatures of the reflected ambient surfaces (ground temperature, celestial temperature). In particular, reflections from celestial areas close to the zenith have been found to be critical because, depending on the cloudiness, the radiation temperatures are considerably different and can significantly influence the signature. A known effect in the case of low-emitting camouflaging devices is the observation of cold spots (that is, surface areas with a radiation temperature which is too low with respect to the background, due to the reflection of cold celestial areas).

In order to take this condition into account, European Patent Document EP 0 250 742 A1 describes a system which controls the thermal emissivity so that the heat radiation of an object can be adjusted within wide limits as desired, by controlling the heat reflection and emission fractions by virtue of a very low energy consumption. This permits a considerable contrast reduction of the thermal radiation with respect to the background. However, the high expenditures for implementing corresponding systems and the necessity of providing additional measuring and regulating devices are disadvantageous.

When low-emitting infrared camouflage devices are used, the geometrical features of the object to be camouflaged must be taken into account. For this purpose, a distinction must be made between:

- surface areas inclined toward the ground;
- horizontal surface areas or those which are inclined toward the sky; and
- surface areas which are vertical or incline slightly (up to approximately 25°) toward the sky.

These surface areas require different embodiments of the camouflaging devices. For surfaces which slope predominantly toward the ground, low-emitting camouflaging devices can be used with a firmly adjusted emissivity which is as low as possible, because the ground temperatures situated in front of the object are reflected independently of the observation point. The radiation temperature of the ground is generally identical to the remaining thermal background. By transmitting this temperature to the object to be camouflaged, a high contrast reduction can be achieved, with a corresponding gain in camouflage effectiveness. In this case, known LE (Low Emission) camouflaging devices can be used, such as LEP (Low Emission Paint) or LEF (Low Emission Foil).

Known low emission camouflaging devices cannot easily be used for surfaces with a predominantly horizontal orientation, because these surfaces, when observable, always reflect predominantly celestial temperatures close to the zenith. Because such celestial temperatures are very low, and may vary considerably depending on the clouding condition, the reflected heat radiation is extremely dependent on the clouding condition. In many cases, horizontal surfaces which are provided with low emission camouflaging devices will therefore have "cold spots" if, as a result of the reflection of the cold sky, the intrinsic emission is overcompensated. A low emission behavior is desirable only to the extent that a reduction of the thermal radiation is necessary, due to increasing solar heating of the surface.

Similar problems exist in the case of surfaces which are oriented upward (angle to the horizontal line smaller than approximately 65°), which can also reflect the celestial radiation.

It is therefore an object of the invention to provide a camouflage system for object surfaces which are essentially oriented horizontally or upward.

Another object of the invention is to provide a camouflage system by which effective camouflaging can be achieved without required measuring and regulating devices.

These and other objects and advantages are achieved by the camouflage system according to the invention, in which a material or a layer system used on the surface of the camouflaging device is characterized by a thermal emissivity $\epsilon$ (T) that has a considerable temperature dependence, with a negative gradient (d/dT) (referred to herein as "thermorefractive material").

As known, the total quantity of heat Q emanating from a body is composed of the intrinsic radiation (product of and the fourth power of the surface temperature $T_O$) and of the reflected ambient radiation (product of $1-\epsilon$ and the fourth power of the temperature of the reflected-in ambient zone $T_U$, here typically the sky):

$$Q(T)\sim\epsilon(T_O),T_O^4+(1-\epsilon(T_O)),T_U^4$$

(The temperatures above relate to the absolute temperature scale.)

If the body is observed by a thermal imager, this law determines the brightness and the contrast function of the individual picture element, and thus the IR signature of the object.

In the case of normal surfaces with $\epsilon \rightarrow 1$, the intrinsic radiation (which increases considerably with temperature) is predominant. According to the invention, a negative temperature coefficient of the thermal emissivity is introduced, and thus the temperature course Q(T) is compensated to the greatest extent possible. If only intrinsic radiation existed, the condition for (T) would have to be:

$$\epsilon(T)\text{-}T_O^{-4}.$$

However, because the reflection term has to be taken into account, the function (T) may extend with a weaker power. More precise estimates indicate that even a linear reciprocal function $$\epsilon(T)\text{-}1/T_O$$

causes a very useful camouflaging effect in practice.

It is important that the thermal emissivity of the overall system decreases markedly within a temperature range which is typically approximately 20 to 40° C.; for example, the emissivity may decrease from values $\epsilon \geqq 0.7$ to values $\epsilon \leqq 0.5$ (in a specific example, from $\epsilon$=0.90 to $\epsilon$=0.5). The lower threshold temperature of the transition range is advantageously equated to the median ambient temperature.

Different mechanisms for achieving a negative temperature coefficient are conceivable in practice. For example, a nonmetal—metal phase transition (MNM transition) can be used. At ambient temperatures, the material is in the nonmetallic or semiconducting condition (IR transparent), and a normal high emission behavior exists when the thermorefractive material is arranged in front of a high emission background. With increasing solar heating, a transition takes place into the metallic condition (IR-reflective) with a resulting lowering of the emissivity. Such a material, which is suitable for the invention, and shows the described MNM transition, is, for example, vanadium oxide ($VO_2$).

Another embodiment of a suitable thermorefractive medium is a composite medium consisting of an IR-transparent matrix, preferably of polyolefine (such as polyethylene) and a dispersed second constituent. The second constituent consists of an alternative organic or polymeric material, also having an IR transparency which is also as good as possible, but with a different temperature course of the refractive indices. For this purpose, liquid, wax-type or semicrystalline hydrocarbons can be used to advantage; however, other substances of low IR absorption in the wavelength range of from 8 to 12 $\mu$m are suitable. The material pairing of matrix and dispersion must be coordinated such that the refraction indices of both materials are approximately identical at ambient temperature but deviate increasingly from one another with rising temperature. Such a system exhibits the desired negative temperature effect: At low temperatures, the material is homogeneously IR-transparent and—if the thermorefractive material is arranged in front of a high-emission background—a normal high-emission behavior will exist. At a higher temperature, the amount of scattering will increase, which results in an increased remission, and thus a lowering of the emissivity. In order to take full advantage of the scattering effect, the dispersions should be significantly larger than the infrared wavelength of approximately 10 $\mu$m which is relevant to the heat image camouflaging. A suitable size for the dispersions is therefore particularly the range greater than 20 $\mu$m.

Because of the temperature-dependent self-regulation of the camouflaging device according to the invention, no additional electronic control system, such as sensors, actuators, triggering electronics and cabling are required. Rather, the emissivity required for an effective camouflaging (and thus the radiation temperatures) will occur automatically. Also, precise site-resolved determination of the surface temperature, which is required by the initially mentioned camouflaging device to adjust the thermal emissivity for each actively controllable IR camouflaging element, is eliminated.

Additional advantages of the invention are:

- a highly effective IR camouflaging is achieved for disparate objects;
- the camouflaging device according to the invention can be implemented in the form of cost-effective robust elements; and
- additional visual camouflaging can be added, in any color.

Other objects, advantages and novel features of the present invention will become apparent from the following detailed description of the invention when considered in conjunction with the accompanying drawings.

DETAILED DESCRIPTION OF THE DRAWINGS

One embodiment of the invention, explained in detail hereinafter, uses vanadium oxide ($VO_2$), which shows the described MNM transition. Below a certain transition temperature, the material is semiconductive and thus IR-transparent. A high emission capacity of the overall structure therefore exists on a high-emission substrate, such as anodized aluminum or a plastic foil. When the structure is heated above a specific transition temperature (in the range of approximately 68° C.), however, a phase change takes place and the $VO_2$ exhibits a metallic behavior with a high IR-reflectivity.

Figure 1:
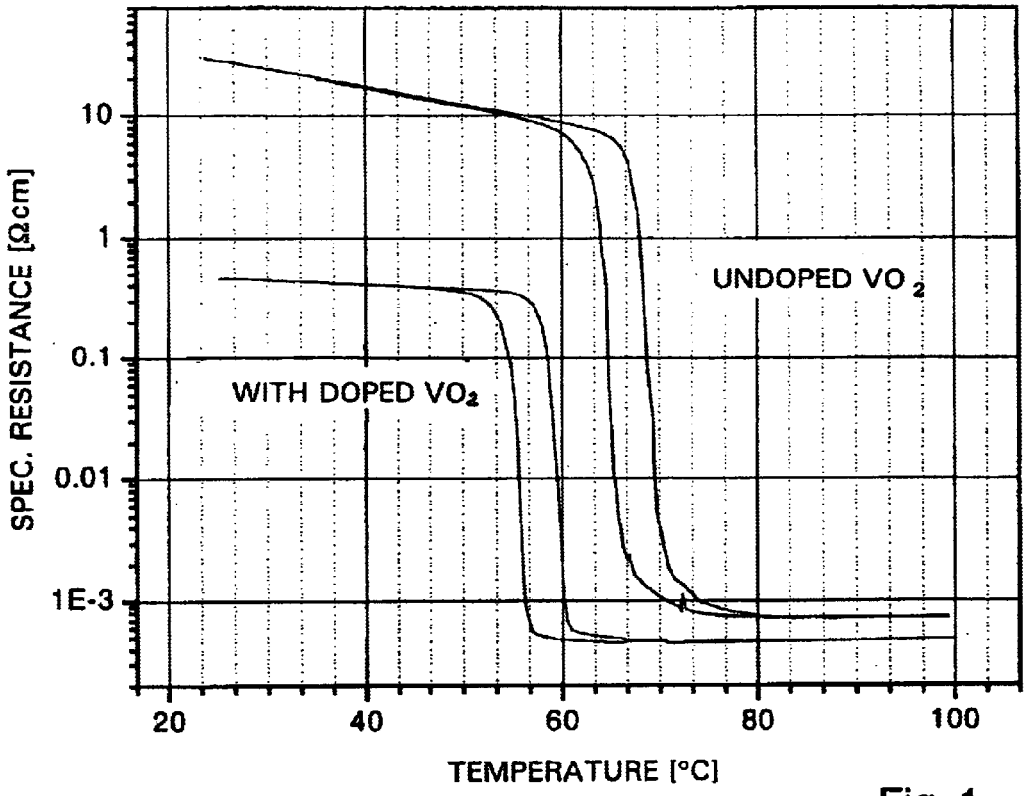
FIG. 1 is a diagram of the temperature-dependent specific resistance of a tungsten-doped $VO_2$-layer in comparison to an undoped $VO_2$-layer.

In order to utilize this effect for IR-camouflaging, a targeted adjustment of both the transition temperature and the width T of the transition range is necessary. This can be achieved by an adaptation of the temperature.-dependent electric conductivity of the vanadium oxide and, in that connection, the IR-reflectivity. One possibility in this respect is to dope the $VO_2$ with, for example, tungsten (G. V. Jorgenson, J. C. Lee, *Solar Energy Mat.* 14 (1986) 205–214). FIG. 1 shows the temperature-dependent change of the conductivity of a $VO_2$ layer in comparison to a tungsten-doped $VO_2$ layer. As illustrated, the transition temperature is lowered, with a displacement to ambient temperatures being possible. It was found that it is also possible to widen the transition range by varying the production parameters of the layer. In this manner, the emissivity of a layer can be adjusted within wide ranges as a function of the temperature.

A solution according to the invention for providing a self-adapting camouflaging for horizontal or upward-oriented surfaces (for example, on a vehicle), therefore provides a camouflaging element with a thermorefractive coating, the emissivity of the layer being adjusted such that, while taking into account the application purpose of the vehicle and optionally the season, a high-emission behavior exists at ambient temperature, and decreases as the temperature increases.

Figure 2:
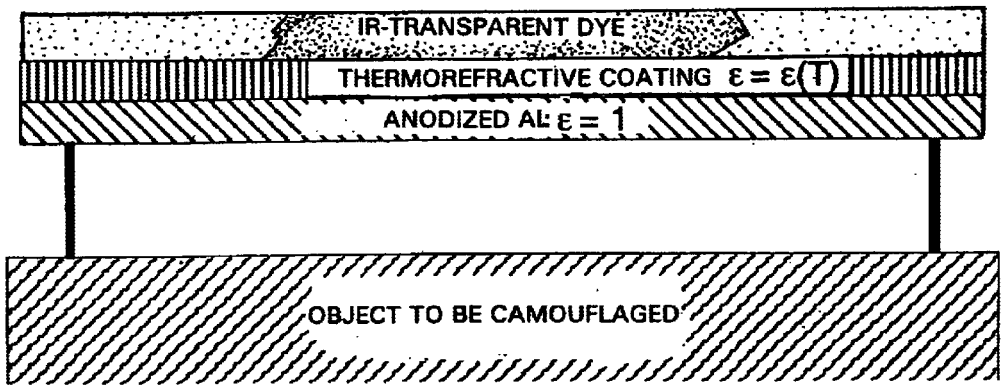
FIG. 2 is a view of an embodiment of the camouflaging device according to the invention.

FIG. 2 shows an embodiment of the camouflaging device according to the invention. It comprises a carrier plate made of anodized aluminum, which has a high emissivity ($\epsilon=1$). The carrier plate is mounted at a distance from the object to be camouflaged and is ventilated in the rear or otherwise thermally insulated with respect to the object, thereby uncoupling the camouflaging device from the characteristic temperature of the vehicle. (That is, its characteristic temperature is largely independent of possible heat sources of the object to be camouflaged.) The carrier plate is coated with the thermorefractive layer according to the invention. As an alternative to direct coating to the metal plate, it is also possible to use a self-adhesive temperature-resistant plastic foil (for example, made of polyimide) which can then be glued to the carrier layer. For a visual camouflage effect, the thermorefractive layer may be provided with an IR-transparent cover layer (such as a pigmented and matted polyethylene foil), which forms the outer surface of the system in the observer's direction.

The IR camouflaging mechanism of this system consists of the coordination of three effects:

At a low surface temperature (night, heavy clouds with low sun radiation), there is no need for any camouflaging and the emissivity of the arrangement is high. The apparent surface temperature is well adapted to the ambient air temperatures and thus to that of the background.

During solar heating, the emissivity decreases as the temperature rises, and therefore compensates the thermal radiation.

Since typically there are few clouds (and therefore low celestial temperatures) when the sun is shining, the temperature-dependent emission behavior of the thermorefractive layer can be preadjusted relatively well and the temperature compensation can therefore take place very effectively.

However, the invention can be used not only for camouflaging surfaces which are essentially horizontal or inclined upward. As will be explained in detail in the following, the invention can also be used to great advantage for camouflaging essentially vertical surfaces (including surfaces which are slightly inclined toward the sky—up to approximately 25° with respect to the vertical line). In this case, it should be taken into account that predominantly vertical surface areas exhibit characteristics that are a mixture of those applicable to surfaces that are horizontal or oriented upward, on the one hand, and those which are inclined toward the ground, on the other hand. According to the observation angle, the reflected heat radiation originates predominantly from areas close to the ground or from the celestial radiation. It is problematic in this case that even small changes of the observation angle (or equivalently: a small change of the surface slope, for example, in the case of moved camouflaged objects) cause a considerable change in the ratio of these fractions.

As a result of suitable surface structures, the vertical surface can be decomposed into partial surfaces that are oriented toward the ground and oriented toward the sky, so that as large as possible a fraction of the radiation reflected on the camouflaging device originates from the ground, while the fraction that originates from sky radiation is as small as possible. In this case, the reflection fractions should remain constant over a slope angle range which is as large as possible. This can be achieved by a surface structure which consists exclusively of two groups of partial surfaces, the partial surfaces of the first group being oriented downward and forming an angle a of between 5° and 45° with the vertical line, and the partial surfaces of the second group being oriented upward and forming an angle $\beta$ of between 40° and 85° with the vertical line, with $\alpha+\beta<90°$. The partial surfaces within the same group may have different angles $\alpha$ or $\beta$.

The upward-oriented partial surfaces, as described above, are coated with a thermorefractive material, while the downward-oriented partial surfaces are coated with a material with a low thermal emissivity. Typical values in this case are $\epsilon \leqq 0.5$.

Figure 3:
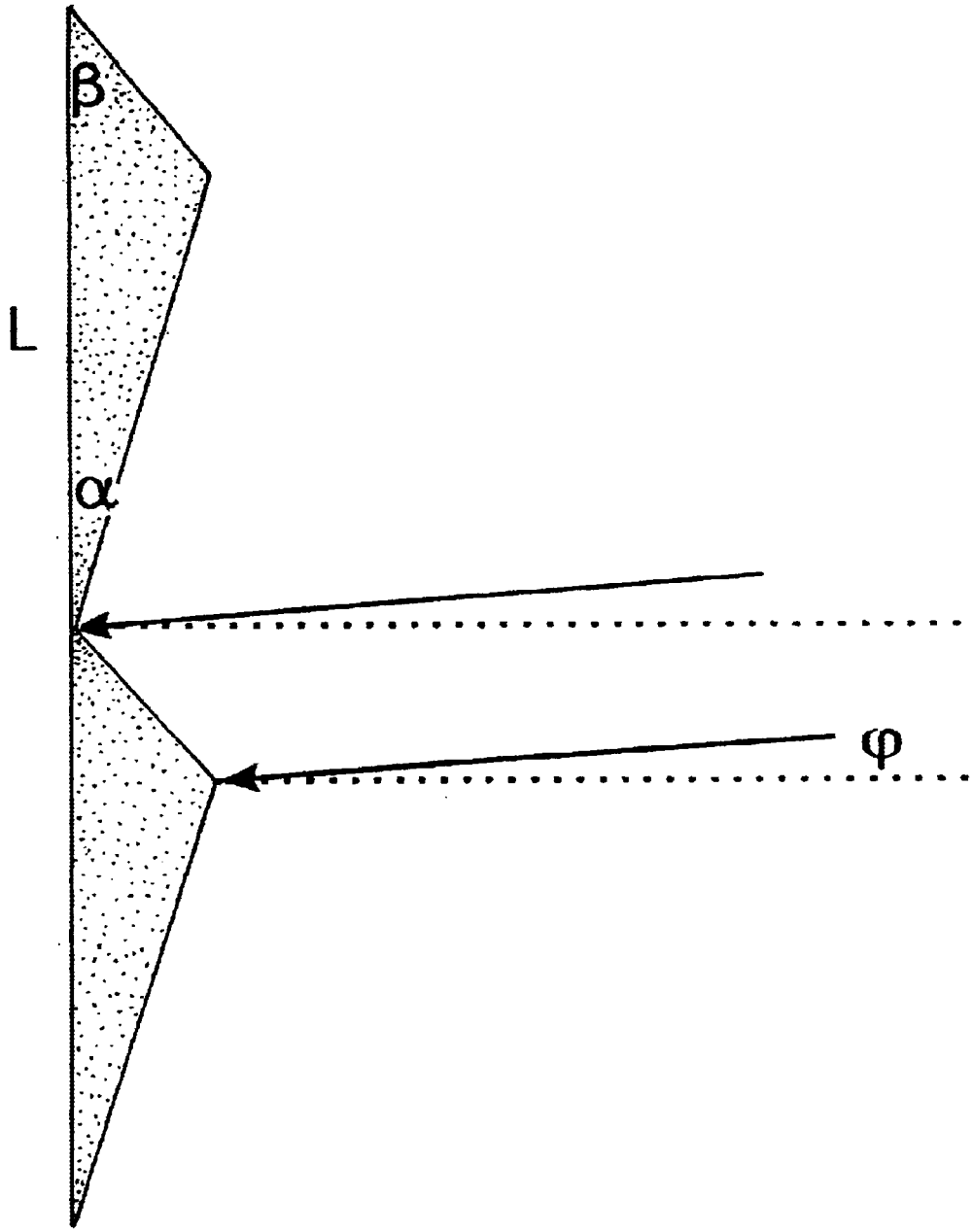
FIG. 3 is a view of another embodiment of the camouflaging device according to the invention.

A geometrical structure which has these characteristics is illustrated in FIG. 3. It consists of a regular sequence of elevations with a triangular cross-section whose hypotenuse (length L) is substantially vertically oriented. It is a groove structure with horizontally oriented asymmetrical grooves. The geometry of the structure is defined by the angles $\alpha$ and $\beta$ and by the structural size L. The angle ($\phi$ is an observer's viewing angle with respect to the horizontal line. Suitable value ranges for the angles $\alpha$, $\beta$ are:

$\alpha$: 5–45° and preferably 15–25°; and $\beta$: 50–85° and preferably 55–70°.

Figure 4:
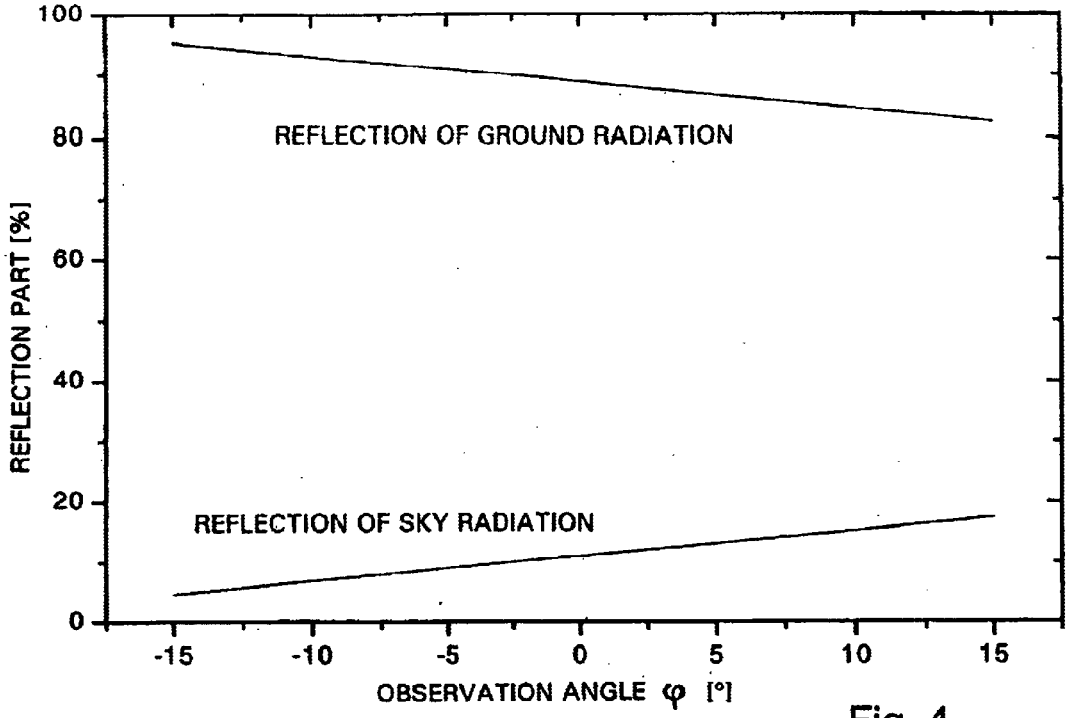
FIG. 4 is a view of the fractions of the radiation reflected on the camouflaging device according to FIG. 3, for the celestial radiation and the ground radiation, as a function of the observation direction.

Taking into account the reflection conditions of the two observable partial surfaces at different angles $\phi$, it is possible to determine the fractions which occur at different angles $\alpha$ and $\beta$ of the structure. FIG. 4 shows the fractions in percent concerning the radiation of this structure reflected by the ground or the sky at different observation angles (p for a particularly favorable geometry with $\alpha=15°$ and $\beta=65°$. As illustrated, the reflective fractions which originate from the sky and from the ground are approximately constant over a large angular range, as desired, the ground fraction being very high.

For maximum effectiveness, the larger downward-oriented partial surface, which reflects the ground fractions, is provided with a layer having a emissivity which is as low as possible (that is of a maximal IR-reflectivity). The smaller, upward-oriented partial surface reflects the sky and, for this reason—as in the case of horizontal surfaces illustrated above—is provided with thermorefractive characteristics. Thus, in the case of hot surfaces, a lower degree of infrared emissions will occur, which contributes to a desired lowering of the radiation level of the overall arrangement.

Figure 5:
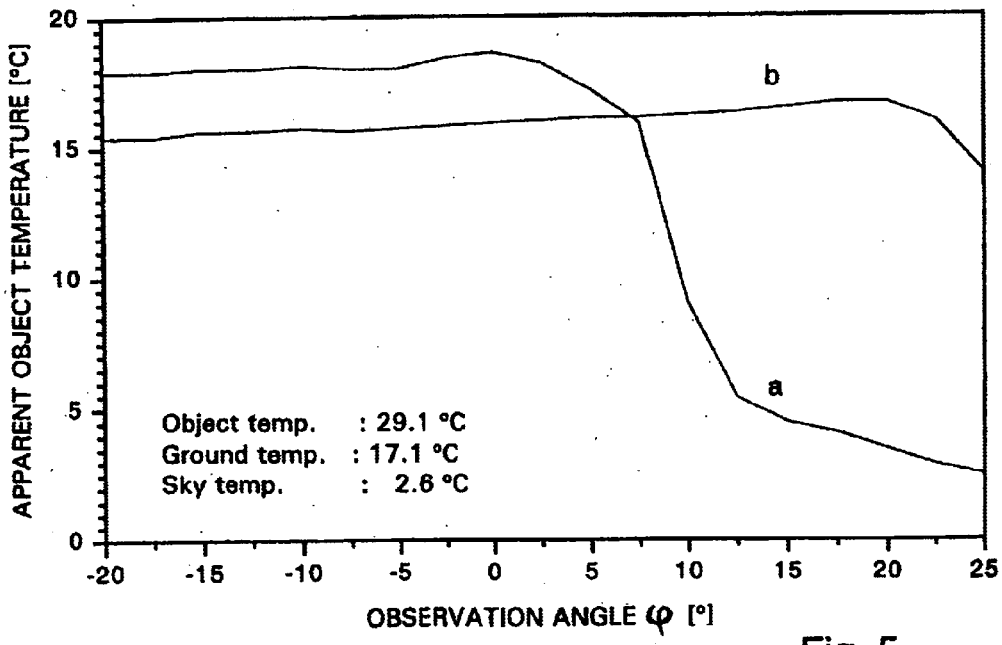
FIG. 5 is a view of the apparent object temperature as a function of the observation direction, when using a camouflaging device according to the invention (curve b) in comparison to a known camouflaging device (curve a).

FIG. 5 shows the radiation temperatures of two surfaces with the same thermal emissivity which were measured at different observation angles $\phi$. Curve a indicates the measured value of an unstructured surface, curve b shows the measured values of a structured surface according to the invention. As can be seen, the radiation temperature of the unstructured sample, starting from a defined angle, drops considerably because of the reflection of a cold celestial surface, while the structured sample in the same irradiation environment, as desired, exhibits virtually no angle dependence of this type.

The structural dimensions of the surface structure are particularly between 12 μm and 1 cm, preferably between 100 μm and 1 mm.

In a particularly advantageous embodiment, the structural dimensions are larger than the wavelength of infrared radiation and smaller than the wavelength of radar radiation. A value range suitable for this purpose is between 20 μm and 1 mm, which ensures that the radar reflecting cross-section is not negatively influenced by multiple reflexes.

To obtain a visual camouflaging effect, an IR-transparent cover layer (such as a pigmented and matted polyethylene foil) can be provided as an outer end of the camouflaging device.

Furthermore, additional camouflaging effects can be achieved according to the principle of spot camouflaging paint coats in which a contour tearing is introduced also in the infrared range. This can be produced very effectively by different thicknesses of the upper color-providing cover layer, so that under all temperature conditions of the system, a spot-type pattern is superimposed on the infrared signature.

The (micro) structuring with the structural values according to the invention can be achieved by various known processes, such as embossing, milling, engraving or photolithographic processes. A correspondingly structured tool can, for example, be used for transferring the structure to a—preferably self-adhesive—plastic foil, for example, by hot-embossing in a calender. A high IR-reflection is generated by metallizing and a subsequent coloring cover layer. Another possibility consists of painting the structure with a low-emission camouflaging paint.

In very small structural values (L approximately 100 μm), it is also possible to provide dyed plastic foils made of IR-transparent materials (for example, polyolefines, such as PE, PP) with the structure by hot embossing, and to apply the IR-reflector by rear-side metallizing. In this case, the structuring also causes the required matting to reduce the visual luster of the plastic foil.

An overall system for camouflaging an object using the camouflaging system according to the invention therefore has the following construction:

The downward-oriented surface areas of the object to be camouflaged are provided with a material which has a low thermal emissivity. Typical values for this purpose are $\epsilon \leqq 0.5$.

The surface areas of the object to be camouflaged which are oriented upward or horizontal are provided with a material which carries out a phase transition from a semiconducting condition, when the temperature increases, into a metallic condition and thus adapts its degree of infrared emissions without an external regulating mechanism to the changed environmental conditions.

On vertical surface areas of the object to be camouflaged, (micro)structuring causes the division of the surface into upward-oriented fractions and downward-oriented fractions.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An infrared camouflage structure, comprising:

an object comprising a passive IR radiation source;

a carrier which is thermally insulated from a surface of said object and has a thermal emissivity $\epsilon \approx 1$; and a layer made of a thermorefractive material whose thermal emissivity has a negative temperature coefficient;

wherein the thermorefractive material comprises vanadium oxide which is doped with a foreign material.

2. The infrared camouflaging system according to claim 1, wherein the negative temperature coefficient takes place by a phase transition from a nonmetallic to a metallic condition.

3. The infrared camouflaging system according to claim 1, further comprising:

a polymid layer glued to the carrier.

4. The infrared camouflaging system according to claim 1, further comprising:

an outwardly exposed surface structure which comprises two groups of partial surfaces, partial surfaces of the first group being oriented downward and forming an angle α of between 5° and 45° with respect to a vertical line, and partial surfaces of the second group being oriented upward and forming an angle β of between 50° and 85° with respect to the vertical line, with $\alpha+\beta<90°$; wherein the downward-oriented partial surfaces are formed by a material with a low thermal emissivity ($\epsilon \leqq 0.5$); and the upward-oriented partial surfaces are formed by a thermorefractive material whose thermal emissivity has a negative temperature coefficient.

5. The infrared camouflaging system according to claim 1, further comprising an outer layer of an infrared-transparent, pigmented and matted cover layer made of a synthetic material.

6. The infrared camouflaging system according to claim 5, wherein the synthetic material is polyethylene.

7. The infrared camouflaging system according to claim 5, wherein the cover layer has spots of different thicknesses.

8. A method for infrared camouflaging of an object, said method comprising providing said object with a surface structure which includes a carrier that is thermally insulated from said object and has a thermal emissivity $\epsilon \approx 1$, and a layer made of a thermorefractive material whose thermal emissivity has a negative temperature coefficient, wherein the thermorefractive material comprises vanadium oxide which is doped with a foreign material.

9. The method according to claim 8, wherein the negative temperature coefficient takes place by a phase transition from a nonmetallic to a metallic condition.

10. The method for the infrared camouflaging of an object according to claim 8, wherein:

downward-oriented surfaces of the object are provided with a coating made of a material with a low degree of infrared emissions; and substantially upwardly oriented surfaces of the object have surfaces formed by a thermorefractive material whose capacity for heat emission has a negative temperature coefficient.

11. The method according to claim 10, wherein:

the downward-oriented surfaces form an angle α of between 5° and 45° relative to a vertical line;

the upwardly oriented surfaces form an angle β of between 50° and 85° relative to a vertical line; and $\alpha+\beta<90°$.

12. The infrared camouflaging system according to claim 1, wherein said foreign material is tungsten.

13. The infrared camouflaging system according to claim 8, wherein said foreign material is tungsten.

* * * * *